US009033166B2

(12) United States Patent
Lehmitz et al.

(10) Patent No.: US 9,033,166 B2
(45) Date of Patent: May 19, 2015

(54) DOUBLE-CHAMBER VESSEL FOR FLOWABLE SUBSTANCES

(75) Inventors: Frank Lehmitz, Hamburg (DE); Gunther Fröhlich, Hamburg (DE)

(73) Assignee: Berner Kunststofftechnik GmbH, Nagold (DE)

( * ) Notice: Subject to any disclaimer, the term of this patent is extended or adjusted under 35 U.S.C. 154(b) by 47 days.

(21) Appl. No.: 13/981,456

(22) PCT Filed: Jan. 24, 2012

(86) PCT No.: PCT/EP2012/051005

§ 371 (c)(1),
(2), (4) Date: Jul. 24, 2013

(87) PCT Pub. No.: WO2012/101100

PCT Pub. Date: Aug. 2, 2012

(65) Prior Publication Data

US 2013/0313216 A1 Nov. 28, 2013

(30) Foreign Application Priority Data

Jan. 24, 2011 (DE) ..... 20 2011 001870 U

(51) Int. Cl.
*B65D 81/32* (2006.01)

(52) U.S. Cl.
CPC ..... *B65D 81/3216* (2013.01); *B65D 81/3227* (2013.01); *B65D 2203/00* (2013.01)

(58) Field of Classification Search
CPC ..... B65D 81/32; B65D 1/04; B65D 1/24; B65D 25/04
USPC ..... 220/4.01, 4.26, 23.87, 495.03, 500, 220/506; 215/6; 222/129
See application file for complete search history.

(56) References Cited

U.S. PATENT DOCUMENTS

| | | | | |
|---|---|---|---|---|
| 2,661,870 | A | 12/1953 | Huenergardt | |
| 3,450,254 | A * | 6/1969 | Gilbert | 206/216 |
| 5,607,076 | A * | 3/1997 | Anthony | 220/501 |
| 5,657,905 | A * | 8/1997 | Glynn | 222/153.1 |
| 7,175,037 | B2 * | 2/2007 | Deir | 215/10 |
| 2006/0213854 | A1 | 9/2006 | Singh et al. | |

FOREIGN PATENT DOCUMENTS

| | | |
|---|---|---|
| DE | 29600895 | 10/1996 |
| DE | 10 2006 036 637 | 2/2008 |
| EP | 1 500 606 | 1/2005 |

(Continued)

*Primary Examiner* — Fenn Mathew
*Assistant Examiner* — Elizabeth Volz
(74) *Attorney, Agent, or Firm* — Sand & Sebolt

(57) ABSTRACT

A double-chamber vessel for flowable substances having a lateral outer wall with a first chamber enclosed by a first, in particular transparent wall and a second chamber enclosed by a second transparent wall in which the first and second chambers each have an opening which openings end commonly in an opening section of the double-chamber vessel, otherwise they are completely separated from each other, wherein the first chamber is an inner chamber that is enclosed by the second chamber, which is an outer chamber, wherein in planar sections the first wall enclosing the first chamber lies directly against the second wall enclosing the second chamber, at the same time forming the lateral outer wall of the double-chamber vessel, or in the planar sections, the second wall forms the first wall and wherein both chambers have a continuous flow connection to the respective openings.

23 Claims, 5 Drawing Sheets

(56) References Cited

FOREIGN PATENT DOCUMENTS

Figure 1:
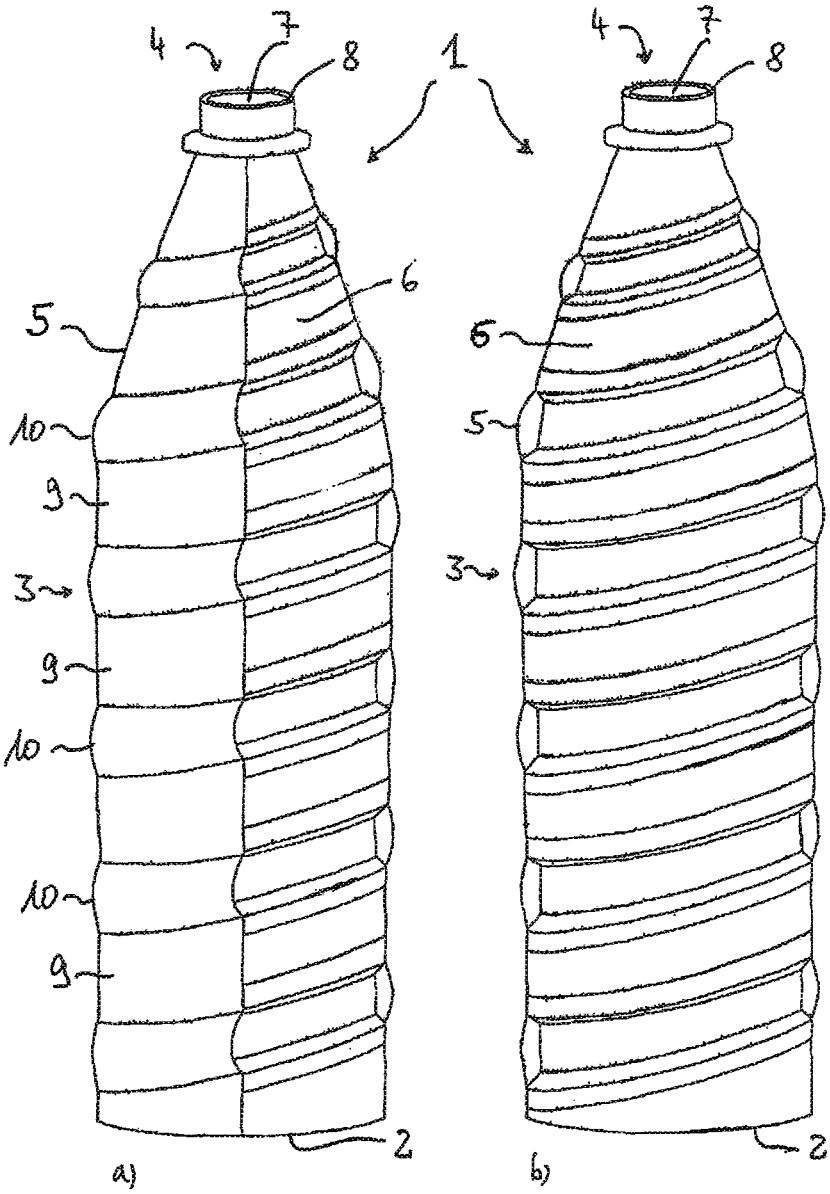

| | | | | | |
|---|---|---|---|---|---|
| WO | 03/020601 | | 3/2003 | | |
| WO | 03020601 | | 3/2003 | | |
| WO | WO03/020601 | * | 3/2003 | ..... | B65D 1/04 |
| WO | WO03020601 | * | 3/2003 | ..... | B65D 1/04 |
| WO | 2004/035418 | | 4/2004 | | |
| WO | 2004035418 | * | 4/2004 | ..... | B65D 81/32 |
| WO | WO2004035418 | * | 4/2004 | ..... | B65D 81/32 |

* cited by examiner

DOUBLE-CHAMBER VESSEL FOR FLOWABLE SUBSTANCES

TECHNICAL FIELD

The present invention relates to a double-chamber for flowable substances which double-chamber vessel has a lateral outer wall, with a first chamber enclosed by a first, in particular, transparent wall as well as a second chamber enclosed by a second transparent wall, wherein the first and second chamber each have an opening that ends jointly in an opening section of the double-chamber vessel, otherwise completely separated from one another, and wherein the first chamber is an inner chamber that is enclosed by the second chamber, which is an outer chamber, wherein, in planar sections, the first wall enclosing the first chamber lies directly against the second wall enclosing the second chamber, that forms the lateral outer wall of the double-chamber vessel at the same time or, in the planar sections, the second wall forms the first wall at the same time, and wherein both chambers have a continuous flow connection to the respective opening.

PRIOR ART

Storing flowable substances, to which liquids belong, in particular, but also viscous substances such as gels, creams, pastes or viscous foods, honey or syrup for example, is known. The single chambers of the vessel are separated such that contact of the flowable substances kept separate therein with each other is prevented before they flow out of the vessel. Such separated storage is used for various flowable substances for various reasons. For example, there are two-component adhesives having initial adhesive pastes, each containing different chemical components, which react with one another and harden when mixed. These substances must be stored separate from one another so that the hardening reaction does not take place during storage and the adhesive or glue becomes unusable, but rather this reaction occurs when the components are mixed at the time of the desired usage.

Separate storage of different flowable substances is known in cosmetics, where different components of skin care cream or the like are to be mixed together only immediately before use. Similarly, this applies in medical fields. Storing flowable foods in double-chamber vessels is also known. This can occur, for example, in order to allow different source materials, such as those of a mixed beverage, like cola and beer, to flow together only immediately before consumption (cf. for an example of this, the utility model DE 296 00 895 U1, which discloses a double-chamber vessel with the characteristic of the preamble of characteristic 1). Finally, the presentation of different liquids with different coloration is particularly interesting from the viewpoint of marketing, if the different colored substances, e.g. a darker and lighter sugar syrup or the like, are stored in different chambers of a double-chamber vessel discernible to the user.

A further double-chamber vessel having a lateral outer wall, with a first chamber enclosed by a first transparent wall as well as a second chamber enclosed by a second transparent wall. wherein the first and second chamber each have an opening that ends jointly in an opening section of the double-chamber vessel, otherwise completely separated from one another, and which would have an application for liquid detergents, is described in DE 10 2006 036 637 A1.

A further double-chamber vessel is described in WO 03/020601 A2. There, the single chambers are disposed above one another, with overlapping areas.

Common to these known double-chamber vessels from the prior art is that they are disposed clearly separate from each other and contain chambers isolated from each other by a separating wall that give a bulky impression to the user in the presentation of the flowable substances stored in the double-chamber vessel, and in which the sizes of the chambers, that can be different depending on the desired contents (cf the above-mentioned DE 29 600 895 U1), are clearly visible to the user by their different sizes. This type of presentation is often felt to be "clumsy".

In US 2006/0213854 A1 a double-chamber vessel in the shape of a bottle is disclosed in which an inner chamber is disposed totally on the inside with no contact with the side wall of the vessel. This inner chamber is turned in a spiral formation but does not, particularly when a non-transparent flowable medium is poured in the volume surrounding the inner chamber of the bottle, contribute to the outer impression of the vessel, here the bottle.

DESCRIPTION OF THE INVENTION

At this point the inventor has thought about an improvement that offers the possibility of an attractive presentation of the flowable substances poured into the double-chamber vessel and further, a greater independence of the design of the volume ratios of both chambers with regard to a still uniform or pleasing outer shape and such a design of the double-chamber vessel.

According to the invention, the double-chamber vessel is constructed such that it has a first inner chamber that is surrounded by a second outer chamber. The second outside wall, which limits the outer chamber on the outside, is transparent and forms, in particular, the lateral outer wall of the double-chamber vessel. In this respect the second outer wall completely encloses the chambers contained in the vessel.

Preferably, the first wall lying inside is transparent as well. This can, however, also be non-transparent—opaque or colored.

At the same time, sections are formed, which are planar sections and in which the wall of the first inner chamber is directly connected to the wall of the second outer chamber in the area of the lateral outer wall, so that between the walls of the first and second chamber no cavity to be filled with the flowable substance in the second chamber remains, or in which the outer wall of the first chamber and the second chamber is formed by a common wall.

In this way, since the otherwise first inner chamber with its outer wall is placed close to the outer chamber in its sections, in these areas of the double-chamber vessel, filled with different flowable substances in the first and second chamber, either the outer wall of the inner chamber or, if this is transparent, the flowable substance contained in the inner chamber, is visible from the outside of the vessel, even if the view of the inner chamber is otherwise covered by a colored, cloudy or, for another reason, non-transparent liquid contained in the outer chamber. In particular, widely varying, optically pleasing effects are easily achieved for the chamber vessel filled with different flowable substances in both chambers. If the double-chamber vessel is created in the form of a bottle, as provided according to a further embodiment of the invention, this bottle can be filled with different liquids, e.g. with cherry juice in the inner chamber and banana juice in the outer chamber. In this example, the cloudy and yellowish beige banana juice in the outer chamber hides the view of the dark red cherry juice stored in the inner chamber everywhere where the wall of the first inner chamber is not close to the wall of the outer chamber. There the viewer of the double-chamber vessel sees the red cherry juice. At this point it is easy to recognize that this type of configuration of the double-chamber vessel results in a great deal of flexibility with regard to design. Here it should just be observed that the second outer chamber is connected as before overall and throughout with its opening, and can thereby be emptied of the flowable substance. Thus the planar sections, in which the first chamber lies with its wall against the wall of the second chamber, for example, may take a circular form (with a curved wall of the outer chamber in the form of corresponding projections), wherein these circular sections can be distributed over the bottle in a regular or varying pattern. These sections may be formed as "islands" of different geometry, square, star-shaped or the like. Likewise a continuously formed surface of planar sections is a possibility that, seen from the outside, is drawn along the wall of the second outer chamber in the form of a spiral that forms the lateral outer wall of the double-chamber vessel at the same time.

Depending on how flowable the flowable substances in the chambers of the double-chamber vessel are, the walls can be rigid (e.g. with liquids) or flexible (e.g. for more viscous pastes that are conveyed out of the double-chamber vessel by pressing).

It should be clear that, without an optical modification of the chosen design of the arrangement and geometry of the planar sections, in which the first chamber with its wall lies directly on the wall of the second chamber, volume ratios of the first and second chambers can be adjusted and changed. This can particularly occur very easily by a change of the wall profile in the areas in which this wall does not lie against the wall of the second chamber. When this wall is pulled further inward, toward the inside of the double-chamber vessel, the volume of the first chamber becomes smaller, the volume of the second chamber larger, and vice versa. Correspondingly, the mixture ratio of both flowable substances, stored separately and running out together for the mixture, can thus be set by an adjustment of the volume ratios of both chambers, if necessary by simultaneous adjustment of the size of their openings, when these flowable substances are poured out of the double-chamber vessel, or squeezed out of it. If, for example, milk and an additive for producing a mixed milk beverage (cocoa product, milk mixed with fruit syrup or the like) are stored separately in such a double-chamber vessel, the milk can be kept in a greater selected volume of the inner chamber, and the additive in a lesser selected volume of the outer chamber. By the appropriate adjustment of both chambers and the openings, that are selected in consideration of the desired mixture ratio, as well as the different viscosities of the exiting components, it is possible to achieve a result in which the mixed milk beverage flows out of the double-chamber vessel in a predetermined mixture ratio so that it has the desired flavor characteristics. Upon emptying the double-chamber vessel, by skillful sizing, the first inner chamber as well as the second outer chamber are emptied in equal measure so that the impression from the outside appears as an even emptying of the vessel.

One variant for implementing such a design consists of forming the planar sections, in which the first wall of the first chamber lies directly against the second wall of the second chamber or is formed in common with the latter, in a continuous spiral-shaped profile, as seen from the outside, extended along the outer wall of the double-chamber vessel.

Alternatively, the double-chamber vessel according to the present invention can also be constructed as a perfume or fragrance bottle. It is then advantageous to install an atomizer in the mouth, particularly a known pump atomizer, that accesses the openings of both chambers and by which the chambers can be emptied. The atomizer can then empty both chambers at the same time by means of an appropriate activation mechanism. Alternatively, and in a particularly preferred variant, the atomizer can be connected alternatively with the first or second chamber by means of a suitable switching mechanism, in order to release only the content of one of the chambers, respectively. As an example, in a perfume bottle of pleasing appearance, eau de toilette (typically in the chamber of greater volume, e.g. the first chamber) and a perfume (typically in the chamber of lesser volume, e.g. the second chamber) can be present at the same time.

Fundamentally, the implementation of a double-chamber vessel according to the invention offers a large degree of freedom in design regarding the proportions of the outer visible surface areas of the first and second chamber and the volume ratios of both chambers. Finally, adjustments can be made independently of the above-mentioned surface area proportion while the relations of the chamber volumes can be selected by varying extensions or expansions in the inside of the vessel.

For the presentation and an impression emphasizing a particular relationship of the different areas, and thereby of the flowable substances contained in the chambers, it was found to be suitable and preferred that a ratio of the surface area of the lateral outer wall, against which the outer wall of the second chamber lies, or it is formed by it, respectively, to the surface area to which the outer wall of the first chamber is exposed, without the outer wall of the second chamber lying against it, be between 4:1 and 1:4, particularly between 3:1 and 1:3, preferably between 2:1 and 1:2.

It is particularly preferred, since it is easy to produce and is associated with low weight, especially in the implementation of the vessel as a bottle, particularly a drink bottle, to make the walls of the first and second chambers out of a transparent plastic, particularly PET. Other plastics, which have can be found useful for a double-chamber vessel according to the invention, can also be considered here, as they are used in the packing industry for respective uses (e.g. bottles, tubes or the like). A bottle constructed as a double-chamber vessel according to the invention can be produced, for example, from such plastic material, first of all as the inner chamber is formed by drawing or injection molding and then enclosed in the outer chamber in a second production step, that can also be produced in an injection molding process, for example. Basically, the chamber walls, and thus the double-chamber vessel, can consist of other suitable materials, e.g. glass, as is preferable for high quality vessels, particularly perfume bottles.

Advantageously the double-chamber vessel has a stopper closing both openings ending commonly in the mouth of the first as well as the second chamber, which stopper can be a screw cap, particularly with a bottle. This stopper is, in particular, equipped, and acts together, with the shape of the vessel in the opening section such that it closes both openings separately in the opening section, so that, in movement due to transportation, and changes of position of the double-chamber vessel, a crossing over of the flowable substance stored in the first chamber of the vessel to the other chamber is eliminated. With a flacon it is advantageous for the atomizer to be the stopper for both chambers at the same time.

The openings of the first and second chambers can especially be constructed such that the opening of the first inner chamber is circular and concentrically surrounded by the annular opening of the second outer chamber. In this arrangement, both flowable substances, stored separately, will be mixed together during the emptying of the double-chamber vessel and, by design of the areal proportions of the area of the circle of the opening lying inside and of the ring of the opening lying outside, a desired discharge of both flowable substances from the first or second chamber can be adjusted.

Especially when the sections, in which the wall of the inner chamber lies against the wall of the outer chamber, or coincides with this, have a complex geometry that makes it difficult for the flowable substance stored in the outer chamber to flow in the areas between these sections, it can be advantageous that at least one second route is created, by which the second outer chamber is connected with the opening belonging to this chamber. Such a second route can, in the case of the above-mentioned design, for example, be a canal-shaped indentation with a section of the coinciding of the wall or walls of the first and second sections in a spiral extending along the outer wall of the vessel in which this spiral-shaped surface is interrupted and a channel is formed between these sections to connect the area of the chamber facing away from the opening to the opening. Here, a tube conducted toward the opening area inside the first chamber, and connected with the second chamber, particularly in a section opposite the opening area to the greatest extent possible may also be considered in the interior of the vessel.

SHORT DESCRIPTION OF THE ILLUSTRATIONS IN THE DRAWINGS

Figure 2:
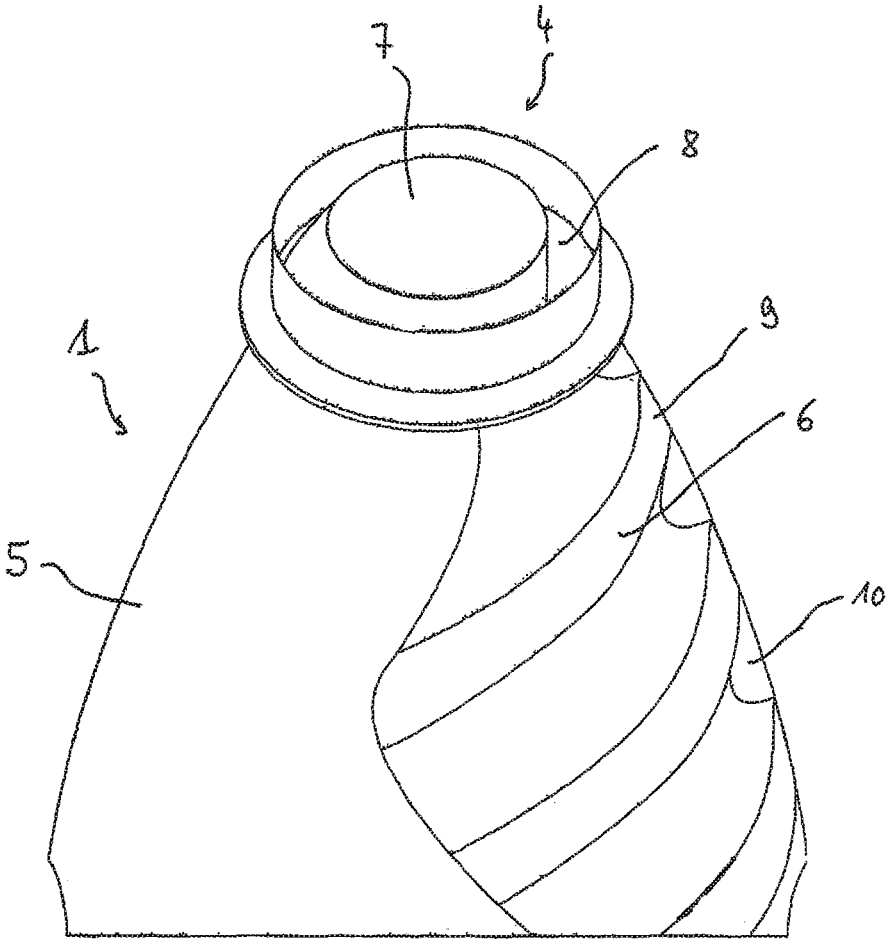
Figure 3:
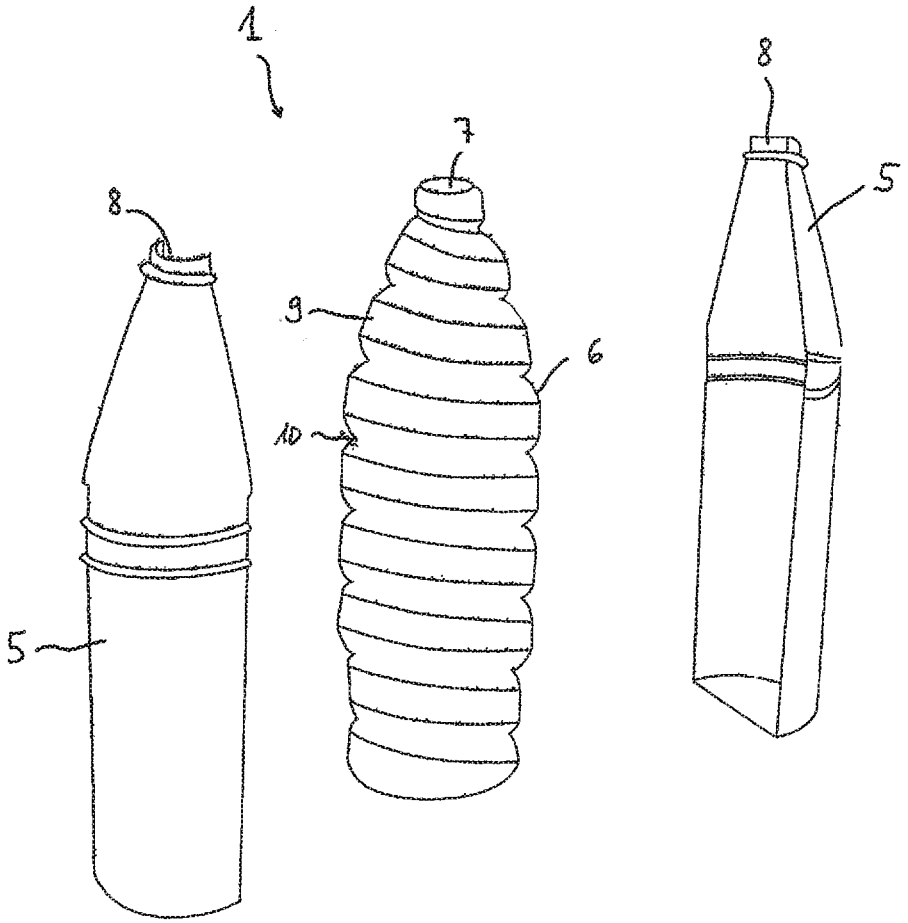
Figure 4:
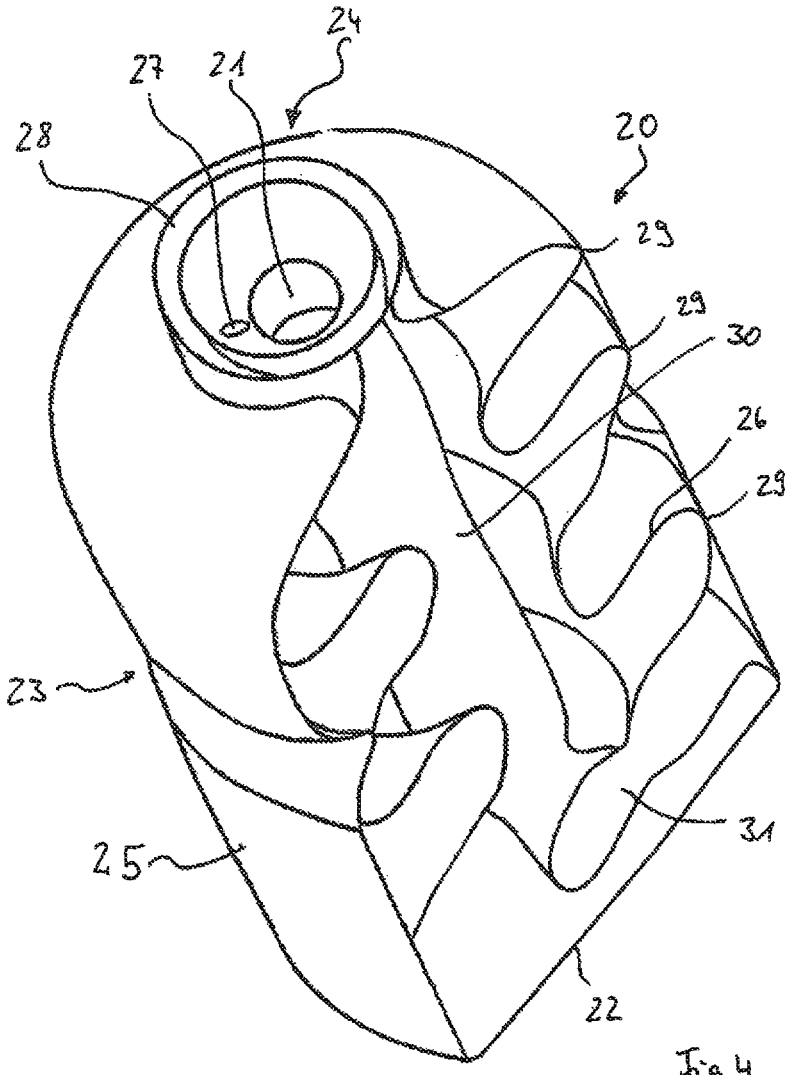
Figure 5:
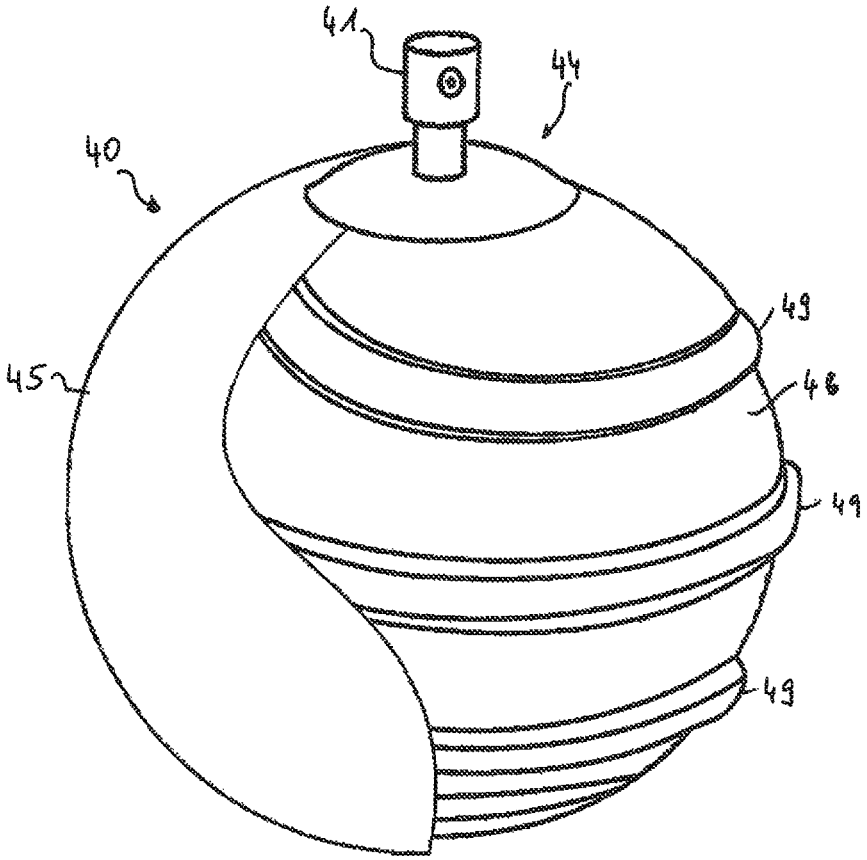

Further advantages and features will arise from the description of an embodiment example based on the figures. These are:

FIG. 1 in two depictions, a) and b), of views, partly cut-away, in different sections of a first embodiment of the double-chamber vessel according to the invention;

FIG. 2 of the top section of the double-chamber vessel in an enlarged and partly cut-away, detail representation according to FIG. 1, with the opening section;

FIG. 3 of the double-chamber vessel according to the invention in an exploded view according to the first embodiment, to illustrate the first, inner chamber as well as the second, outer chamber, and their alignment to each other;

FIG. 4 of a cross-section illustration with a second embodiment of a double-chamber vessel according to the invention in the form of a bottle, and FIG. 5 of a partially cut way view of a third embodiment of double-chamber vessel according to the invention in the form of a perfume flacon.

MEAN(S) OF EXECUTING THE INVENTION

In the figures, schematically possible embodiments of a double-chamber vessel according to the invention are shown, whereby the invention is not limited to these concrete embodiments and their geometry. The figures are neither drawn to scale thereby, nor accurate in all structural details, rather, they represent illustrations of principles in the nature of sketches.

To begin with, a first embodiment is described with reference to FIGS. 1 to 3. A double-chamber vessel 1 for flowable substances is represented in FIG. 1*a* and lb in a partly cut-away view wherein the views of FIG. 1*a* and FIG. 1*b* differ in the varying cut-away areas.

The double-chamber vessel 1 is a bottle in this case, particularly a beverage bottle, with a bottle bottom 2, an elongated bottle body 3 with a lateral outer wall and an opening area 4 lying opposite the bottle bottom 2 on the upper side of the double-chamber vessel 1. This opening area 4 is, as usual in such bottle-type vessels, closeable by a screw cap, not shown here, so that the space or spaces or chambers (see below concerning this) contained in the double-chamber vessel 1 and enclosed by it can be firmly sealed in order to prevent leakage or outflow of the flowable substance from the inside of the double-chamber vessel 1.

Completely enclosed by an outer wall 5, the double-chamber vessel 1 contains a further wall 6, lying inside, that encloses an inner chamber. This inner chamber that is bordered by the inner wall 6 has an opening 7 located in the opening area 4.

The outer wall 5, which completely encloses the inner wall 6, and the inner wall 5 border, between themselves, a second, outer chamber that likewise ends in an opening 8 in the opening area 4, wherein the opening 8 is formed around the opening 7 in the form of a slit and concentrically thereto.

According to the invention, the outer wall 5 is connected, in areas 9, with the wall 6 lying inside directly and without leaving a cavity; in other areas 10 the outer wall 5 diverges from the wall 6 lying inside to form a cavity lying between them, which forms the outer chamber.

In this embodiment, this is designed so that the areas 10 altogether continuously complete a spiral or coil-shaped course over which the outer chamber is formed, passing along outer wall of the bottle-shaped double chamber vessel 1 from its bottom of the bottle 2 to the opening area 4, more precisely to the opening 8.

With the double-chamber vessel 1 according to the invention, the outer wall 5, particularly, is designed to be transparent, whereby, preferably the inner wall 6 can also be transparent. Each of the different areas 9 and 10, respectively, have a different appearance because of the transparent design of the outer wall 5. Through the areas 10, the observer sees from the outside, when the second chamber is filled, the contents of this chamber, the corresponding flowable substance, for example a colored juice or colored lemonade. In the areas 9, the observer is directly aware of the inner wall 6 located behind the outer wall 5, if this is not transparent but rather colored or opaque, or of the content of the inner chamber straight through this inner wall 6, for example a juice or lemonade in another color. Altogether there is an impression of two colors, which has a spiral-shaped course changing in color, in the embodiment of the double-chamber vessel 1 shown.

In the variant of a double-chamber vessel 1 represented here, it is possible, in particular, to vary the respective volume of the inner and outer chamber by designing the distance between the outer wall 5 and the inner wall 6 in the area 10, in which the cavity remains between these walls 5, 6, and thereby adjust the ratio of both these volumes. In this way, for example, the components of a mixed beverage, which should be obtained only upon flowing out of the double-chamber vessel 1, can be stored separately, whereby, at the same time, the mixture ratio can be set by the ratio of the volumes of the inner chamber and the outer chamber. In order to achieve an appropriate outflow from the respective openings 7 and 8, the ratio of the opening cross-sections of these openings can be adjusted to balance accordingly.

For the double-chamber vessel 1 shown here, in order to facilitate an outflow from the outer chamber volume, extending here in a spiral along the double-chamber vessel 1, a ventilation web can be made, essentially in a vertical direction transverse to the course of the spiral track, wherein the connection of outer wall 5 with the inner wall 6, even raised in the areas 9, thus facilitates a direct afterflow of air upon emptying the volume of the outer chamber.

In FIG. 2 the upper section of the double-chamber vessel 1 with the opening section 4 is shown in an enlarged representation to illustrate once more the position of the opening 7 to the inner chamber and the opening 8 to the outer chamber in their alignment to each other. Yet again, the areas 9, in which the outer wall 5 lies against the inner wall 6 directly and without a cavity, in differing from the areas 10, in which there is a gap and thus the volume of the outer chamber is formed, can be readily distinguished.

Finally, it is shown in FIG. 3, in a type of exploded view, how the double-chamber vessel 1 of the invention is equally composed of an inner vessel, bordered by the inner wall 6, and an outer vessel, bordered by an outer wall 5, placed over the former. It can be readily seen that the spiral coiled notch, where the inner wall 6 of the inner vessel recoils and later, with the outer wall 5, is connected with the inner wall, thus forms the volume of the outer chamber that runs along the longitudinal direction of the double-chamber vessel 1.

In FIG. 4 there is a second embodiment of a double-chamber vessel according to the invention in a cross-sectional perspective view, and indicated therein with the numeral 20. Basically this double-chamber vessel 20 is constructed in analogy to the one shown and described above. It has a bottle bottom 22, a bottle body 23 and an opening area 24 in a section along a longitudinal axis opposite the bottle bottom 22. This one also has and outer wall 25 and an inner wall 26. The outer wall 25 encloses a first chamber wherein a second chamber is formed, separate from this first chamber, in an area between the outer wall 25 and the inner wall 26, which chamber lies against the outer wall in areas 29 and there forms the surface of the lateral outer wall. These areas 9 form together a spiral-type continuous band as is also the case by the embodiment already outlined above.

What is novel here is that a further opening 31 is provided in the opening area 24, with which a tube 30, disposed in the inside of the first chamber of the double-chamber vessel 20, leads to the opening area. The tube 30 is connected with the second chamber formed between the inner wall 26 and the outer wall 25 in the area of a mouth 31, which lies near the bottle bottom 22. This chamber can alternatively be emptied through the opening 21 or the opening 27 whereupon air can flow through the other opening respectively for ventilation of the chamber.

In FIG. 5 another embodiment according to the invention is shown in a partially cut-away view. Here the double-chamber vessel 40 is a bottle for perfume or similar fragrance. As with the examples shown above, an outer wall 45 and an inner wall 46 are provided, wherein a first chamber is formed, and there is a second chamber between the inner wall 46 and the outer wall 45 inside of the double-chamber vessel 40. The inner wall 46 is placed on the outer wall (here cut-way) in the areas 49 that, as a whole, wind around the vessel in the form of a spiral.

A pump atomizer 41 is disposed in an opening area 44, that is connected by corresponding tubes leading into the first or second chamber, to the volumes enclosed therein. The pump atomizer can then be toggled by means of twisting, so that it is either in active connection with the tube going into the first inner chamber or with the tube to the second outer chamber, coiled in a spiral extending around the first chamber. Thus the contents of one or the other chamber can be withdrawn and sprayed with the spray head. With this variant of the invention, an eau de toilette of a fragrance, for example, can be located in the first inner chamber with greater volume, and a perfume of the same fragrance, in the second chamber of smaller volume, formed between the inner wall 46 and the outer wall 45. The fragrance supplier could fill the volumes with fragrances for a man and for a woman, for example, in order to make possible the shared use of a "couple's flacon" for couples. Then, an appropriate adjustment and selection of the volume ratio could be made by the above-outlined measure for an expansion of the volume of the second chamber by displacing the inner wall 46 inward in the interior of the vessel.

The embodiments depicted here in the figures are to be understood as possible design variants of the invention and an illustration thereof. In particular, there are very different and variously designed forms of the double-chamber vessel of the invention in which the geometry of the areas 9, 29 or 49 (the same areas in which the outer walls 5, 25 and 45, respectively, are directly connected to with the inner walls 6, 26 and 46) and 10 (the same areas in which a gap remains between the outer walls 5, 25, and 45 and the inner walls 6, 26 and 46 to form a volume of the outer chamber) assumes various designs. For example, the areas 5, 25, 45 extend in a circular or punctiform manner over the double-chamber vessel, or take a totally different course (e.g. crosses, hearts, stars or the like). The invention is also not limited to bottle-shaped vessels of flacons.

The double-chamber vessel can thus take other forms, e.g. tubes for cosmetics or food pastes.

LIST OF REFERENCE NUMERALS

1 Double-chamber vessel
2 Bottle bottom
3 Bottle body
4 Opening area
5 Outer wall
6 Inner wall
7 Opening
8 Opening
9 Area
10 Area
20 Double-chamber vessel
21 Opening
22 Bottle bottom
23 Bottle body
24 Opening area
25 Outer wall
26 Inner wall
27 Opening
28 Opening
29 Area
30 Tube
31 Mouth
40 Double-chamber vessel
41 Pump atomizer
44 Opening area
45 Outer wall
46 Inner wall
49 Area

The invention claimed is:

1. A double-chamber vessel for flowable substances, which double-chamber vessel comprises:

a first chamber enclosed by a first wall;

a second chamber enclosed by a transparent second wall, the second wall comprises a lateral outer wall of the double-chamber vessel that is adapted to be contacted by a consumer, wherein the first and second chamber each have an opening that ends jointly in an opening section of the double-chamber vessel, said chambers being otherwise completely separated from one another, wherein the first chamber is an inner chamber that is enclosed by the second chamber, which is an outer chamber, and wherein, in planar sections, a portion of the first wall enclosing the first chamber lies directly against the lateral outer wall of the double-chamber vessel or is connected to part of the lateral outer wall, and wherein both chambers have a continuous flow connection to the respective opening and wherein the planar sections extend along the lateral outer wall of the double-chamber vessel in a continuous spiral-shaped course, where, seen from the outside, the first wall of the first chamber lies directly against the lateral outer wall or is constructed in common with the latter.

2. The double-chamber vessel according to claim 1, wherein the first wall and second wall are made from transparent glass.

3. The double-chamber vessel according to claim 1, wherein the opening of the first inner chamber is circular and surrounded concentrically by the opening of the second outer chamber which is annular in shape.

4. The double-chamber vessel according to claim 1, wherein an inside of the second outer chamber is connected with the opening belonging to the second chamber by at least two paths.

5. The double-chamber vessel as defined in claim 1, wherein the second wall of the second chamber forms the entire lateral outer wall of the vessel.

6. The double-chamber vessel as defined in claim 1, wherein the first chamber is completely enclosed by the second chamber.

7. The double-chamber vessel as defined in claim 1, wherein when the first wall is positioned directly against or connected to the lateral outer wall, no cavities exist between the first wall and the lateral outer wall in the planar sections.

8. The double-chamber vessel as defined in claim 1, wherein the first wall is transparent or opaque or colored.

9. The double-chamber vessel according to claim 1 wherein the vessel has the form of a bottle.

10. The double-chamber vessel according to claim 9 wherein the vessel has the form of a beverage bottle.

11. The double-chamber vessel according to claim 1 wherein the vessel has the form of a perfume or fragrance bottle.

12. The double-chamber vessel according to claim 11, further comprising an atomizer that is disposed on the opening section and is selectively connectable with one of the chambers, or is connectable with both chambers at the same time.

13. The double-chamber vessel according to claim 1, wherein the portion of the first wall that lies directly against the lateral outer wall or is connected to part of the lateral outer wall has a first surface area; and the rest of the lateral outer wall which does not have the portion of the first wall directly thereagainst or connected to the part thereof, has a second surface area; and wherein the ratio of the first surface area to the second surface area is from about 4:1 to about 1:4.

14. The double-chamber vessel according to claim 13, wherein the ratio of the first surface area to the second surface area is from about 3:1 to about 1:3.

15. The double-chamber vessel according to claim 13, wherein the ratio of the first surface area to the second surface area is from about 2:1 to about 1:2.

16. The double-chamber vessel according to claim 1, wherein the first and the second walls are made from a transparent plastic.

17. The double-chamber vessel according to claim 16, wherein the first and the second walls are made from PET.

18. The double-chamber vessel according to claim 1, further comprising a stopper jointly closing the openings of the first and the second chamber, ending jointly in the opening section.

19. The double-chamber vessel according to claim 18 wherein the stopper is a screw cap.

20. A double-chamber vessel flowable substances, which double-chamber vessel comprises:

a first chamber enclosed by a first wall;

a second chamber enclosed by a second wall, the second wall comprises a lateral outer wall of the double-chamber vessel that is outer wall that is adapted to be contacted by a consumer, wherein the first and second chamber each have an opening that ends jointly in an opening section of the double-chamber vessel, said chambers being otherwise completely separated from one another, wherein the first chamber is an inner chamber that is enclosed by the second chamber, which is an outer chamber, and wherein, in planar sections a portion of the first wall enclosing the first chamber lies directly against the lateral outer wall of the double-chamber vessel or is connected to part of the lateral outer wall, and wherein both chambers have a continuous flow connection to the respective opening; and wherein the planar sections of the inner wall which lie in direct contact with or are connected to the lateral outer wall are separated from each other by regions of the inner wall that are spaced a distance from the lateral outer wall.

21. A double-chamber vessel flowable substances, which double-chamber vessel comprises:

a first chamber enclosed by a first wall;

a second chamber enclosed by a second wall, the second wall comprises a lateral outer wall of the double-chamber vessel that is adapted to be contacted by a consumer, wherein the first and second chamber each have an opening that ends jointly in an opening section of the double-chamber vessel, said chambers being otherwise completely separated from one another, wherein the first chamber is an inner chamber that is enclosed by the second chamber, which is an outer chamber, and wherein, in planar sections, a portion of the first wall enclosing the first chamber lies directly against the lateral outer wall of the double-chamber vessel or is connected to part of the lateral outer wall, and wherein both chambers have a continuous flow connection to the respective opening; and wherein the second wall comprises an outermost wall of the second chamber and the first wall comprises an innermost wall of the second chamber.

22. A double-chamber vessel comprising:

a bottom wall;

a lateral outer wall extending upwardly from the bottom wall; said bottom wall and outer wall bounding and defining an interior space;

a first chamber having a first wall; wherein the first wall is positioned completely within the interior space; and wherein a second chamber is formed between the first wall and the outer wall; and wherein at least a portion of the first wall is positioned in direct contact with the outer wall or is connected thereto; and wherein the inner wall is spiraled or coiled.

23. The double-chamber vessel as defined in claim 22, wherein the outer wall is transparent and the inner wall is transparent or opaque or colored.

* * * * *